US011703012B2

(12) United States Patent
Koch et al.

(10) Patent No.: US 11,703,012 B2
(45) Date of Patent: Jul. 18, 2023

(54) ENGINES WITH MULTIPLE THRUST BEARINGS

(71) Applicant: Toyota Motor Engineering & Manufacturing North America, Inc., Erlanger, KY (US)

(72) Inventors: Samuel D. Koch, Ann Arbor, MI (US); Yeongching Lin, Ann Arbor, MI (US); Toshiharu Noguchi, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 905 days.

(21) Appl. No.: 14/964,462

(22) Filed: Dec. 9, 2015

(65) Prior Publication Data

US 2017/0167434 A1 Jun. 15, 2017

(51) Int. Cl.
*F02F 7/00* (2006.01)

(52) U.S. Cl.
CPC ..... *F02F 7/0053* (2013.01)

(58) Field of Classification Search
CPC ..... F02F 7/0053; F02B 41/00; F02B 75/065
USPC ..... 123/197.1, 197.4
See application file for complete search history.

(56) References Cited

U.S. PATENT DOCUMENTS 5,564,837 A * 10/1996 Putnam ..... F02F 7/0053 384/429
7,322,336 B2 1/2008 Paul et al.
2007/0261659 A1* 11/2007 Tidwell ..... F16C 9/04 123/197.4
2008/0253709 A1* 10/2008 Kikuchi ..... F01M 11/03 384/473
2012/0325178 A1* 12/2012 Walters ..... F02P 7/06 123/197.4
2013/0220268 A1 8/2013 Bednarz

FOREIGN PATENT DOCUMENTS

JP 2011179518 A 9/2011
JP 2011179664 A 9/2011
JP 5003656 B2 8/2012
JP 5635481 B2 12/2014

* cited by examiner

*Primary Examiner* — Lindsay M Low
*Assistant Examiner* — Omar Morales
(74) *Attorney, Agent, or Firm* — Christopher G. Darrow; Darrow Mustafa PC

(57) ABSTRACT

An internal combustion engine includes a crankshaft. The crankshaft includes multiple crank journals, at least two crank pins positioned between two of the multiple crank journals that neighbor one another, and at least one pin arm. Each pin arm may be positioned between two of the crank pins neighboring one another. Arrangements may include multiple crankshaft supports and multiple thrust bearings. These elements may be distributed about the crankshaft such that two or more of the multiple crankshaft supports have at least one associated thrust bearing. Each of the crankshaft supports having the associated thrust bearing may support one of the multiple the crank journals. Each thrust bearing may be positioned between the crankshaft and the crankshaft support having the associated thrust bearing.

23 Claims, 9 Drawing Sheets

ENGINES WITH MULTIPLE THRUST BEARINGS

FIELD

The present disclosure generally relates to engines and, more specifically, to supporting arrangements for crankshafts of internal combustion engines.

BACKGROUND

In an internal combustion engine, a crankshaft is used to convert reciprocating motion to rotational motion. For example, the crankshaft converts linear reciprocating motion of pistons into a rotational output of the engine. Different techniques have been used in an effort to create more efficient engines. Such techniques may include, for example, lengthening the stroke of the pistons and/or increasing the compression ratio of the engine cylinders. These, along with other changes to the engine, can increase forces acting on the crankshaft during engine operation.

SUMMARY

The present disclosure is directed to internal combustion engines that support crankshafts having certain configurations of crank pins and crank journals. For example, for engines having a crankshaft with at least two crank pins located between neighboring crank journals, multiple thrust bearings can be distributed about two or more crankshaft supports.

In one embodiment, the present disclosure is directed to an internal combustion engine and supporting arrangements for a crankshaft. The engine may include a crankshaft having multiple crank journals. The crankshaft may also include at least two crank pins positioned between two crank journals neighboring one another. The crankshaft may also include one or more pin arms. Each pin arm may be positioned between two of the crank pins neighboring one another. The engine may include multiple crankshaft supports and multiple thrust bearings. The thrust bearings may be distributed about the crankshaft such that two or more of the crankshaft supports have at least one associated thrust bearing. Each of the crankshaft supports having the associated thrust bearings may support one of the crank journals. Each thrust bearing may be positioned between the crankshaft and the crankshaft support having the associated thrust bearing.

In another embodiment, the engine may include a crankshaft having six crank pins, four crank journals, and three pin arms. The engine may also include multiple crankshaft supports configured to support the crankshaft at the four crank journals. The engine may also include a first set of thrust bearings located on opposing sides of a first crankshaft support. The engine may also include a second set of thrust bearings located on opposing sides of a second crankshaft support. In this embodiment, at least one exterior crankshaft support may not have an associated thrust bearing.

DETAILED DESCRIPTION

This detailed description relates to the support of a crankshaft in particular configurations of an internal combustion engine. The internal combustion engine may have multiple crankshaft supports configured to support the crankshaft. The crankshaft supports can have associated thrust bearings positioned between the crankshaft support and the crankshaft. Some arrangements described herein can have thrust bearings positioned near two or more crankshaft supports where the crankshaft includes two or more crank pins between neighboring crank journals. Such arrangements can improve the reliability of the engine and may improve the safety factor of the crankshaft. For example, multiple thrust bearings may decrease the displacement between the crank journals in the longitudinal direction. Additionally, multiple thrust bearings may facilitate the management of forces acting on the crankshaft at least in the longitudinal direction.

In one or more arrangements, the crankshaft may include multiple crank journals supported by multiple crankshaft supports. As used herein, the term "multiple" means two or more. Arrangements of the crankshaft may include additional elements (e.g. crank pin(s), journal arm(s), and/or pin arm(s)). Such elements may be located between neighboring crank journals and may be distributed in any suitable manner. For instance, in one or more arrangements, at least two crank pins may be located between neighboring crank journals. In one or more arrangements, multiple thrust bearings may be distributed about the crankshaft such that two or more of the multiple crankshaft supports have at least one associated thrust bearing. In one or more arrangements, the thrust bearings may also be positioned such that there is one crank pin positioned between a pin arm and a nearest thrust bearing.

Figure 1:
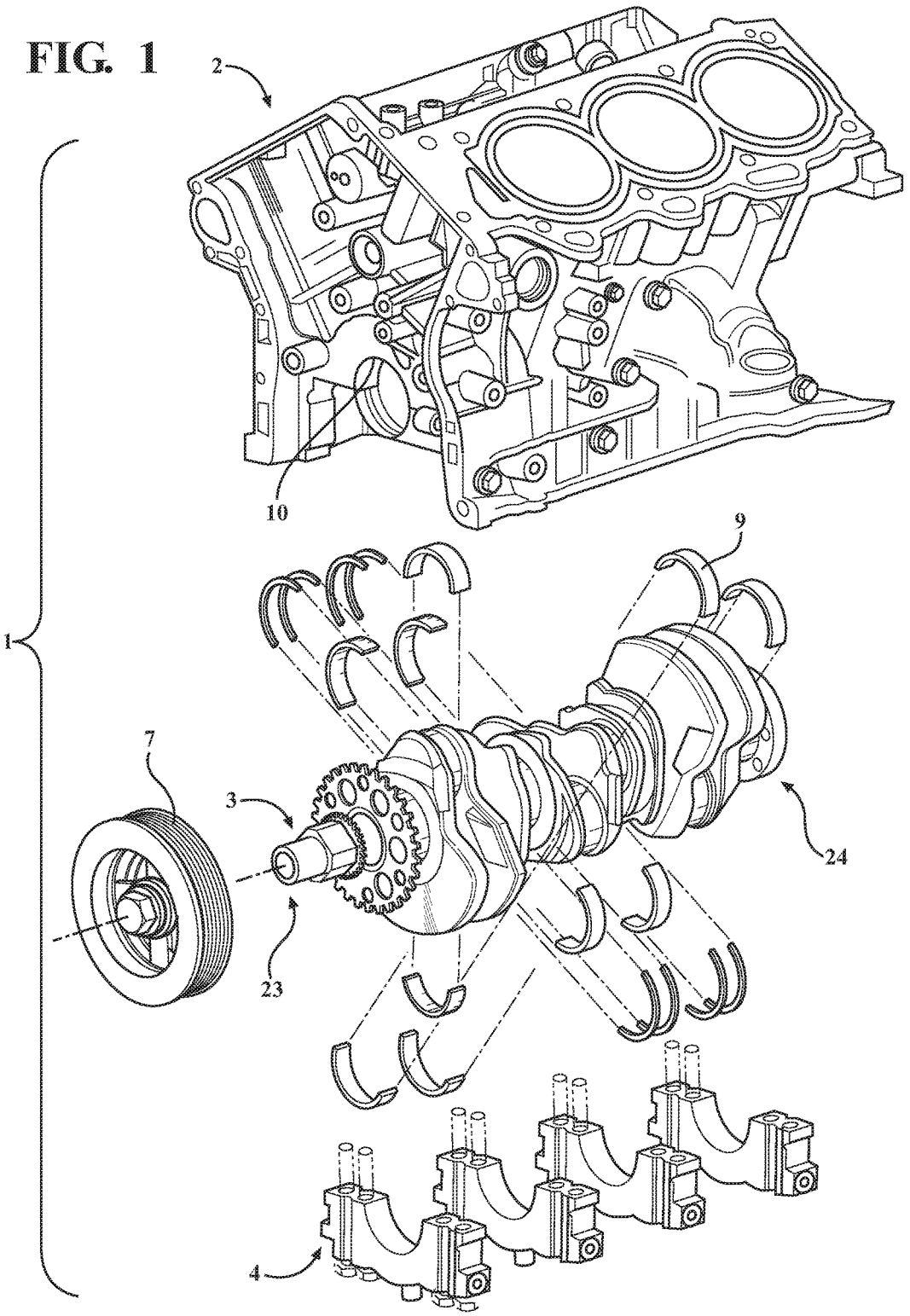
FIG. 1 is an exploded view of part of an internal combustion engine.

FIG. 1 shows an exploded view of part of an internal combustion engine 1. Some of the various possible elements of the internal combustion engine 1 shown in FIG. 1 will now be described. It will be understood that it is not necessary for the internal combustion engine 1 to have all of the elements shown in FIG. 1 or described herein. The internal combustion engine 1 may include an engine cylinder block 2 and a crankshaft 3. The cylinder block 2 can define one or more cylinder(s) of a reciprocating engine. The engine crankshaft 3 is a mechanical shaft configured to convert reciprocating motion into rotational motion. The internal combustion engine 1 may be any suitable type of engine. The crankshaft 3 may be configured for any suitable type of engine. For instance, in the arrangement shown in FIG. 2, the crankshaft 3 may be configured for use in a V6 engine. However, it will be understood that arrangements described herein are not limited to being used in connection with V6 engines.

Figure 2:
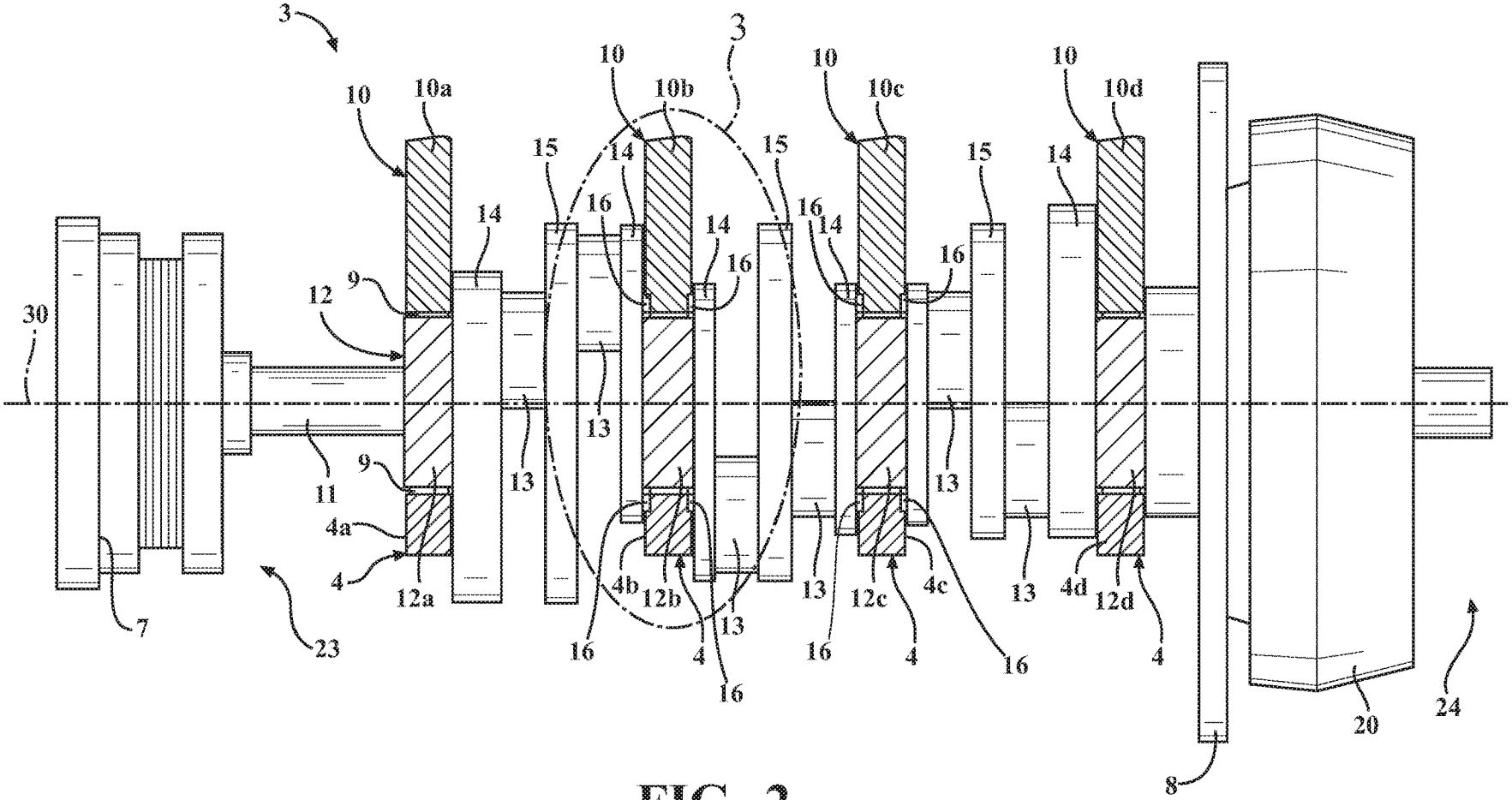
FIG. 2 is a partial cross-sectional view of an example of a crankshaft with supporting structures, showing a first arrangement of multiple thrust bearings.

In one or more arrangements, the crankshaft 3 may be operatively connected to various engine components. As used herein, the term "operatively connected" may include direct and indirect connections, including connections without direct physical contact. Operatively connected may include arrangements in which the connected components are fixed relative to each other, as well as those arrangements in which at least one of the connected components may move relative to one or more other connected components. Various examples of such arrangements are shown in FIGS. 1 and 2. For instance, a first end 23 of the crankshaft 3 may be operatively connected to a pulley 7. The pulley 7 may be operatively connected to a variety of pumps and/or generators via a belt or other element to transmit rotational energy from the crankshaft 3 to the pumps and/or generators. The motor/generator may convert the rotational energy to electrical energy, which may be used to power one or more components of a vehicle or system. The second end 24 of the crankshaft 3 may be operatively connected to a flywheel 8 and a clutch 20. A drive plate or a torque converter (not shown) may also be connected to the second end 24 of the crankshaft 3.

The crankshaft 3 may include multiple crank journals 12. The crank journals 12 are physical structures that provide areas of the crankshaft 3 support from the block structure. For example, the crank journals 12 can be supported in the radial direction by the crankshaft supports via radial bearings 9. In one or more arrangements, the radial bearings 9 can be two piece plain radial bearings. The crankshaft 3 may have any suitable quantity of crank journals 12. In one or more arrangements, the crankshaft 3 may have four crank journals 12, as is shown in FIG. 2. In one or more arrangements, the crank journals 12 may be formed together with the crankshaft 3 as a unitary structure.

In one or more arrangements, the crank journals 12 of the crankshaft 3 may be substantially aligned along a longitudinal axis 30 of the crankshaft 3. For purposes of clarity, the individual crank journals 12 will be described based on their position along the longitudinal axis 30. For example, the crank journals 12 may include a first crank journal 12*a*, a second crank journal 12*b*, a third crank journal 12*c*, and a fourth crank journal 12*d*. The first crank journal 12*a*, the second crank journal 12*b*, the third crank journal 12*c*, and the fourth crank journal 12*d* may be sequentially distributed along the longitudinal axis 30 from the first end 23 of the crankshaft 3 to the second end 24 of the crankshaft 3, as is shown in FIG. 2.

In one or more arrangements, other elements of the crankshaft 3 and/or other elements associated with the crankshaft 3 may be located between neighboring crank journals 12. As used herein, "neighboring crank journals" means any two cranks journals with no other crank journal located between them. For example, in the arrangement shown in FIG. 2, the first crank journal 12*a* and the second crank journal 12*b* may be neighboring crank journals. Likewise, the second crank journal 12*b* and the third crank journal 12*c* may be neighboring crank journals. Examples of such other elements located between neighboring crank journals 12 may include one or more crank pins 13, one or more journal arms 14, and/or one or more pin arms 15.

The crankshaft 3 may include one or more crank pins 13. The crank pin 13 is a physical structure configured for operative connection to a connecting rod of an engine piston (not shown). The crank pin 13 may rotate around the longitudinal axis 30 as the engine piston reciprocates. As a result, reciprocating motion of the engine piston may be converted to rotational motion of the crankshaft. There may be any suitable quantity of crank pins 13. In one or more arrangements, the crankshaft 3 may have six crank pins 13, as is shown in FIG. 2. In one or more arrangements, the crank pins 13 may be formed together with the crankshaft 3 as a unitary structure. The crank pins 13 may be located at different positions relative to the longitudinal axis 30. In some arrangements, the crank pins 13 may be positioned at different angular orientations. For example, each crank pin 13 may be positioned such that there is a 60 degree shift between adjacent crank pins.

In one or more arrangements, a journal arm 14 may be positioned between each crank journal 12 and an adjacent crank pin 13. The journal arm 14 may be a physical structure that directly or indirectly connects the crank journal 12 and an adjacent crank pin 13. In one or more arrangements, the journal arm 14 can transfer forces between the adjacent crank pin 13 and the crank journal 12. As used herein, "adjacent crank pin" may include the nearest crank pin on either side of a crank journal. Other engine elements may be connected to the journal arm 14, such as a counter weight, for example.

In one or more arrangements, crank pins 13 may be positioned between neighboring crank journals 12. For example, there may be two crank pins 13 positioned between each set of neighboring crank journals 12. During engine operation, forces applied to the crank pins 13 may cause the crankshaft 3 to rotate. Such rotation of the crankshaft 3 may subject the crank journals 12 to certain forces. In one or more arrangements, a pin arm 15 may be positioned between two crank pins 13 as shown in FIG. 2. As used herein, "pin arm" may include any physical structure between two crank pins 13. The pin arm 15 may be a physical structure that directly or indirectly connects two crank pins 13. In one or more arrangements, the pin arm 15 can transfer forces between the two crank pins 13.

In one or more arrangements, the internal combustion engine 1 may include multiple crankshaft supports. The crankshaft supports may include any structure that supports and/or positions the crankshaft 3 in one or more directions. For instance, the crankshaft supports may support the crankshaft 3 in one or more radial directions of an axis of the crankshaft 3. The crankshaft supports may be configured to support the crankshaft 3 at the crank journals 12.

In one or more arrangements, the crankshaft supports may include one or one or more block supports 10 and/or more cap supports 4, as is shown in FIG. 1. The block supports 10 are crankshaft supports that are defined by the engine cylinder block 2. The cap supports 4 are crankshaft supports that are defined by a crank cap. In one or more arrangements, the block support 10 and the cap support 4 together can substantially enclose an outer peripheral surface of an associated crank journal 12.

In one or more arrangements, the individual crankshaft supports may define a channel. For example, each block support 10 may define a downward facing channel, and each cap support 4 may define an upward facing channel. The terms "downward" and "upward" are used for convenience and are not intended to be limiting. Indeed, depending on the orientation of the internal combustion engine 1, the channels defined by the crankshaft supports may face other directions. The channels may have any suitable shape. In one or more arrangements, the channels may be substantially semi-cylindrical.

The crank journals 12 of the crankshaft 3 may be sized, positioned, and/or otherwise configured to engage the channels defined by the crankshaft supports. The crankshaft supports may be distributed along the crankshaft 3 in any suitable manner. For instance, the crankshaft supports may be distributed along the crankshaft 3 in a direction that is substantially parallel to a longitudinal axis 30 of the crankshaft 3. As used herein, the term "substantially" includes exactly the term it modifies and slight variations therefrom. Thus, for example, the term "substantially parallel" includes exactly parallel and slight variations therefrom.

For clarity, the crankshaft supports (e.g., the block supports 10 and/or the cap supports 4) may be described based on their relative position along the longitudinal axis 30. For example, the block supports 10 may include a first block support 10*a*, a second block support 10*b*, a third block support 10*c*, and a fourth block support 10*d*, as shown in FIG. 2. In one or more arrangements, the block support 10 at each end of the distributed block supports 10 may be described as being exterior block supports. For example, in the arrangement shown in FIG. 2, the first block support 10*a* and the fourth block support 10*d* may be exterior block supports. The block supports 10 positioned between the exterior block supports may be described as being interior block supports. For example, in the arrangements shown in FIG. 2, the second block support 10*b* and the third block support 10*c* may be interior block supports.

Similarly, the cap supports 4 may include a first cap support 4*a*, a second cap support 4*b*, a third cap support 4*c*, and a fourth cap support 4*d*. The cap support 4 located at each end of the distributed cap supports 4 may be described as exterior cap supports. For example, in the arrangement shown in FIG. 2, the first cap support 4*a* and the fourth cap support 4*d* may be described as being exterior block supports. The cap supports 4 positioned between the exterior cap supports may be described as being interior cap supports. For example, in the arrangements shown in FIG. 2, the second cap support 4*b* and the third cap support 4*c* may be interior cap supports.

In one or more arrangements, each of the crankshaft supports may correspond to one of the crank journals 12. For example, the first block support 10*a* and/or the first cap support 4*a* may support the first crank journal 12*a*, the second block support 10*b* and/or the second cap support 4*b* may support the second crank journal 12*b*, etc.

In one or more arrangements, each of the cap supports 4 may be operatively connected to the engine cylinder block 2. For example, each cap support 4 may be operatively connected to a respective block support 10. Thus, the first cap support 4*a* may be operatively connected to the first block support 10*a*, the second cap support 4*b* may be operatively connected to the second block support 10*b*, the third cap support 4*c* may be operatively connected to the third block support 10*c*, and the fourth cap support 4*d* may be operatively connected to the fourth block support 10*d*. In some arrangements, the cap support 4 may be connected to the engine cylinder block 2 by one or more fasteners. For example, one or more bolts may extend through the cap support 4 and into the block support 10 of the engine cylinder block 2.

Figure 3A:
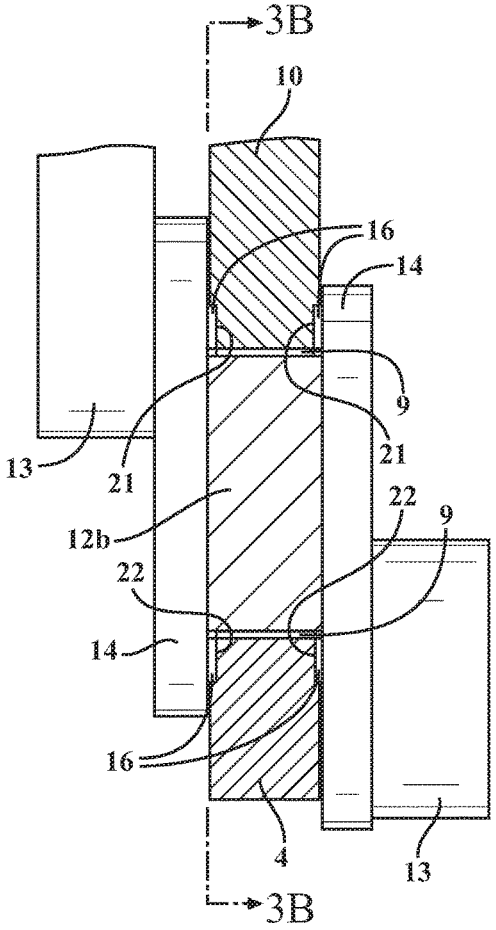
FIG. 3A is a close-up view of a portion of the crankshaft and supporting structures of FIG. 2.
Figure 3B:
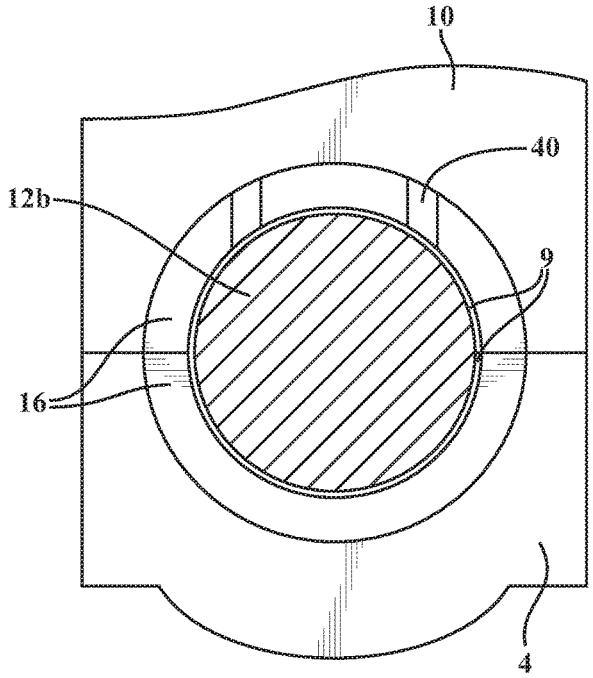
FIG. 3B is a partial cross-sectional view of a portion of the crankshaft and supporting structure, viewed along line 3B-3B in FIG. 3A.

In one or more arrangements, each crank journal 12 may be supported by the crankshaft supports via radial bearings 9 (see FIGS. 3A and 3B). As mentioned previously, in some arrangements, the radial bearings 9 can be two piece plain radial bearings. The radial bearings 9 may be configured to be positioned between the crankshaft supports and the crank journals 12 of the crankshaft 3. For example, a radial bearing 9 may be positioned between each of the block supports 10 and a respective one of the crank journals 12. Similarly, a radial bearing 9 may be positioned between each of the cap supports 4 and a respective one of the crank journals 12. The radial bearings 9 may be configured to support the crankshaft 3 in one or more radial directions. In addition, the radial bearings 9 can reduce friction created between the rotating crankshaft 3 and the crankshaft supports. Therefore, the radial bearings 9 may facilitate the rotation of the crankshaft 3 smoothly and stably. The radial bearing 9 may have any suitable shape. The radial bearing 9 may have a substantially similar shape or a shape that corresponds to the channel of the crankshaft support that it used with. As an example, the radial bearing 9 may be semi-cylindrical. One or more surfaces of the radial bearing 9 may include one or more lubrication channels therein. Such lubrication channels may be used for cooling and/or lubricating purposes.

The crankshaft 3 may also be supported by multiple thrust bearings 16. In one or more arrangements, each thrust bearing 16 may be positioned between the crankshaft 3 and one of the crankshaft supports. For example, a thrust bearing 16 may be positioned between the crankshaft 3 and one of the block supports 10 and/or one of the cap supports 4. The thrust bearings 16 may have any suitable size, shape, and/or configuration. For example, each thrust bearing 16 may have a substantially semi-cylindrical shape (e.g., shaped like a half washer). Arrangements of the multiple thrust bearings 16 may improve the reliability of the engine and may improve the safety factor of the crankshaft 3. As used herein, "safety factor" may include any value indicating safeness against mechanical failure of a mechanical part. For example, the safety factor may describe the structural capacity of the mechanical part beyond the expected loads or actual loads. The multiple thrust bearings may decrease the displacement between the crank journals in the longitudinal direction. Additionally, the multiple thrust bearings may facilitate the management of forces acting on the crankshaft at least in the longitudinal direction. For example, some lateral forces acting on the crankshaft may be reduced by the multiple thrust bearing and/or the multiple thrust bearings may provide improved distribution of forces acting on the crankshaft. Therefore, the reliability of the engine and the safety factor of the crankshaft may be improved. As a result, the multiple thrust bearings may provide benefits similar to increasing the strength and/or stiffness near one or more pin arms of the crankshaft.

The thrust bearings 16 may be arranged in any suitable manner along the crankshaft 3. In one or more arrangements, a pair of thrust bearings 16 may be positioned between the second block support 10*b* and the crankshaft 3, as is shown in FIG. 3A. For example, the thrust bearings 16 may be positioned on opposing sides of the second block support 10*b*. Similarly, another pair of the thrust bearings 16 may be positioned between the second cap support 4*b* and the crankshaft 3. For example, the thrust bearings 16 may be positioned on opposing sides of the second cap support 4*b*. In some arrangements, there may be thrust bearings 16 positioned around the second and third block supports 10*b* and 10*c*, and thrust bearings 16 positioned around the second and third cap supports 4*b* and 4*c*. One example of such an arrangement is shown in FIG. 2.

In one or more arrangements, the positioning of the thrust bearings 16 may be described relative to other components. For example, some arrangements may include thrust bearings 16 being positioned such that there is only one crank pin 13 and only one journal arm 14 between each pin arm 15 and a thrust bearing 16 nearest to the pin arm, as is shown in FIG. 2. As used herein, "nearest to the pin arm" means located closest to the pin arm in the longitudinal direction.

FIG. 3A is a close-up view of a portion of the crankshaft with supporting structures. More particularly, FIG. 3A shows a close-up view of the second crank journal 12*b* and nearby components. In one or more arrangements, one or more channels may be defined in the block supports 10 and/or the cap supports 4 for receiving at least a portion of a thrust bearing 16. For example, the second block support 10*b* may define one or more channels 21. The channels 21 may have any suitable shape. For instance, the channels 21 may substantially correspond to the shape of at least a portion of the thrust bearings 16. For instance, the channels 21 may have a substantially semi-cylindrical shape. In one or more arrangements, the channels 21 may be defined in opposing sides of the second block support 10*b*. While FIGS. 3A and 3B present the second block support 10*b*, it will be understood that the above description is applicable to the other block supports 10.

Further, the second cap support 4*b* may define one or more channels 22. The channels 22 may have any suitable shape. For instance, the channels 22 may substantially correspond to the shape of at least a portion of the thrust bearings 16. For instance, the channels 22 may have substantially semi-cylindrical shape. In one or more arrangements, the channels 22 may be defined in opposing sides of the second cap support 4*b*. While FIGS. 3A and 3B present the second cap support 4*b*, it will be understood that the above description is applicable to the other cap supports 4.

The thrust bearings 16 may be received at least partially within one or more of the channels 21, 22 defined in the block support 10 and/or the cap support 4. In one or more arrangements, each thrust bearing 16 may receive forces transmitted from the crankshaft 3 in a direction parallel to the longitudinal axis 30.

In one or more arrangements, the thrust bearings 16 may include additional features. For example, an oil channel 40 (see FIG. 3B) may be defined in a surface of the thrust bearing 16. Such an oil channel may be used for cooling and/or lubrication purposes. Further, the thrust bearings 16 may be configured to prevent rotation with respect to the crankshaft supports. For example, the thrust bearings 16 may include one or more protrusions (not shown) from a surface thereof. Such a protrusion may prevent rotation in any suitable manner. For instance, the protrusion may engage the block support 10 and/or the cap support 4 to prevent relative rotation of the thrust bearing 16.

FIG. 2 shows a first arrangement of multiple thrust bearings 16 for supporting the crankshaft 3. More particularly, the thrust bearings 16 may be associated with the second crankshaft support and the third crankshaft support. For example, the thrust bearings 16 may be positioned on opposing sides of the second block support 10*b* and on opposing sides of the third block support 10*c*. In addition, the thrust bearings 16 may be positioned on opposing sides of the second cap support 4*b* and opposing sides of the third cap support 4*c*.

It will be understood that these arrangements are merely one example and that numerous variations are possible. For instance, in some arrangements, a thrust bearing 16 may be positioned on only one side of a respective crankshaft support. For instance, FIGS. 4-9 show different arrangements of a crankshaft 3 being supported within an engine system such that the thrust bearings 16 are positioned at two or more crankshaft supports. Each of these arrangements will be described in turn below.

Figure 4:
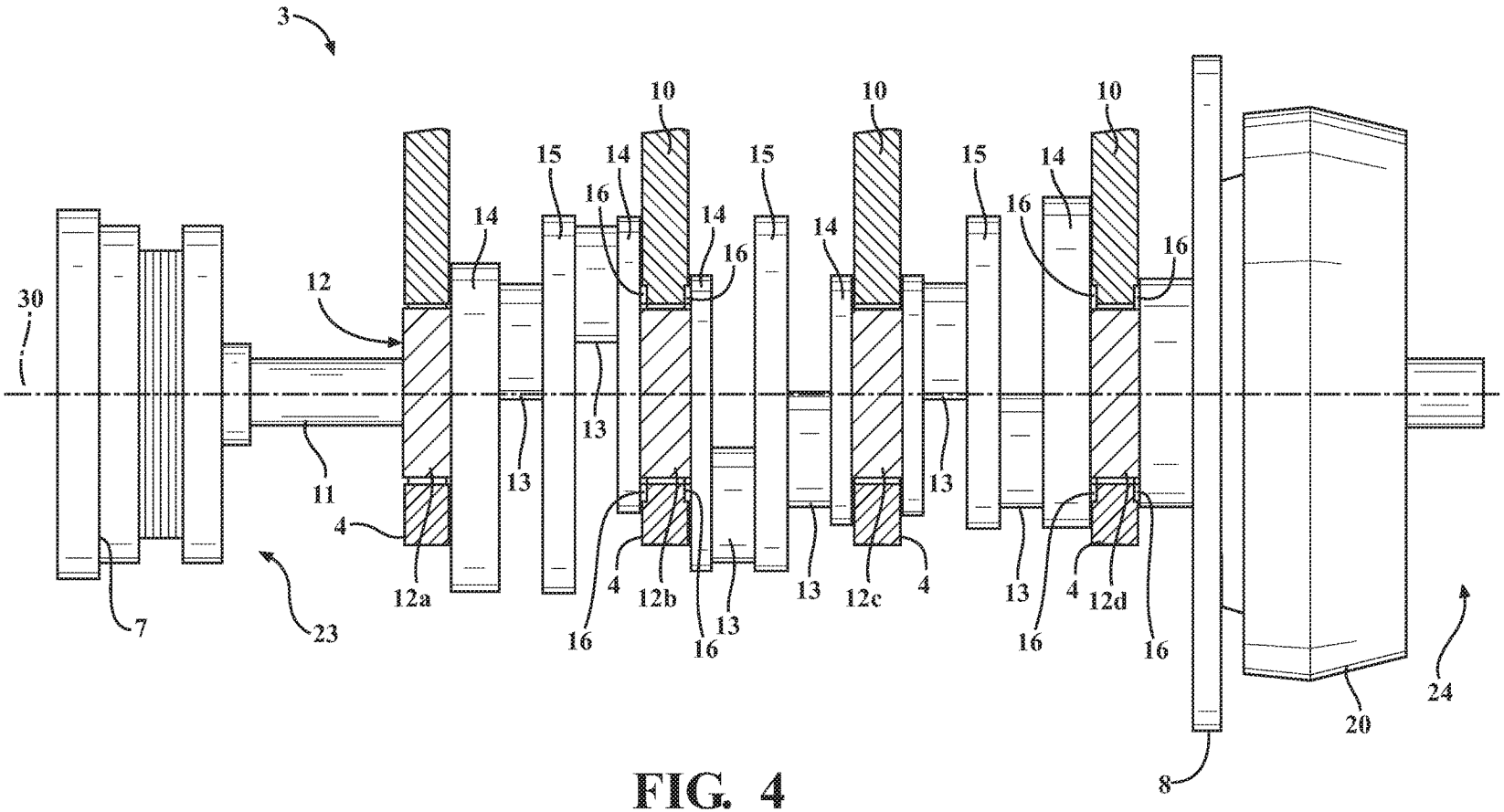
FIG. 4 is a partial cross-sectional view of an example of a crankshaft with supporting structures, showing a second arrangement of multiple thrust bearings.

FIG. 4 shows a second arrangement of multiple thrust bearings 16 for supporting the crankshaft 3. More particularly, the thrust bearings 16 may be associated with the second crankshaft support and the fourth crankshaft support. For example, the thrust bearings 16 may be positioned on opposing sides of the second block support 10*b* and on opposing sides of the fourth block support 10*d*. In addition, the thrust bearings 16 may be positioned on opposing sides of the second cap support 4*b* and opposing sides of the fourth cap support 4*d*.

Figure 5:
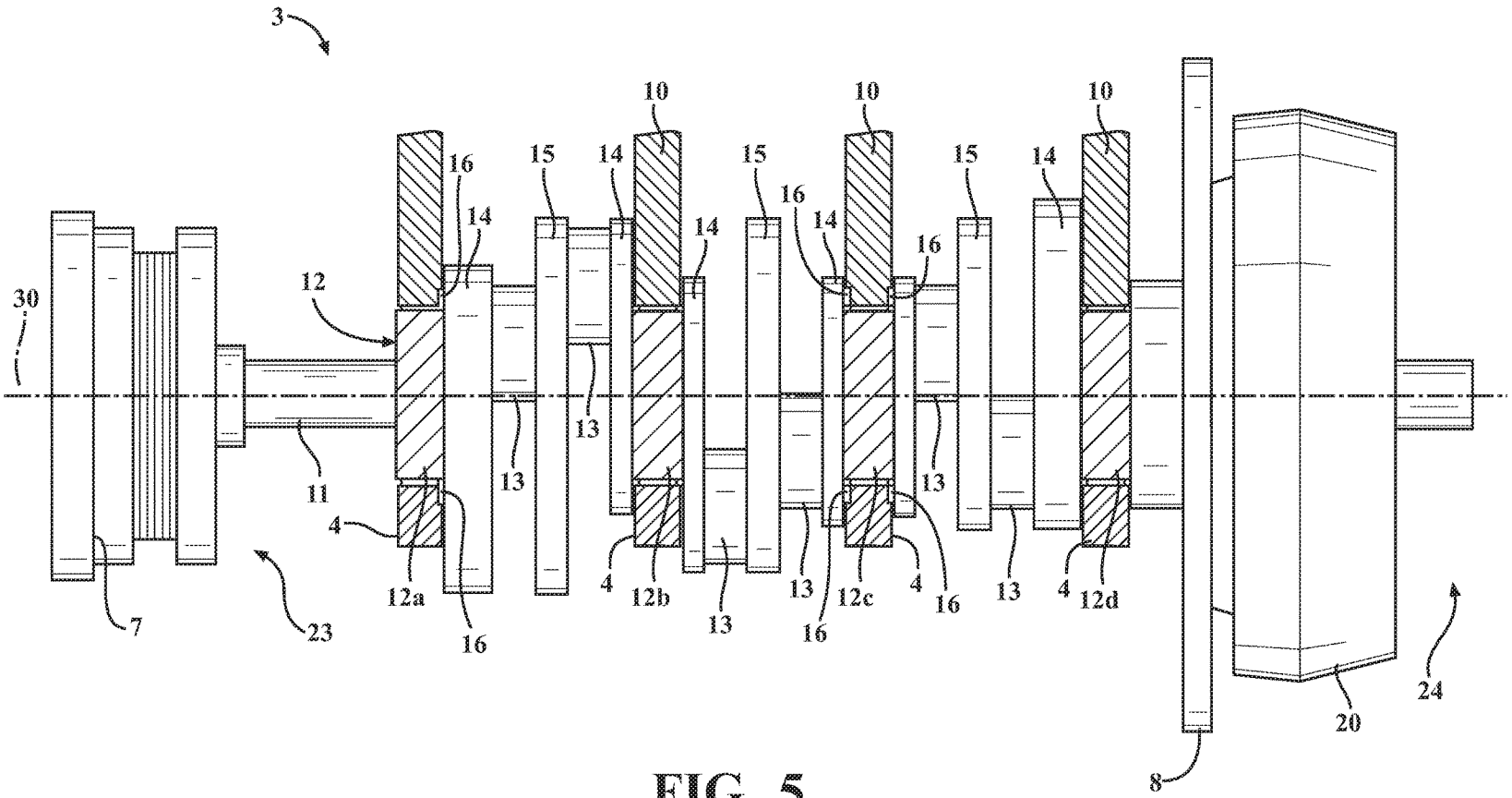
FIG. 5 is a partial cross-sectional view of an example of a crankshaft with supporting structures, showing a third arrangement of multiple thrust bearings.

FIG. 5 shows a third arrangement of multiple thrust bearings 16 for supporting the crankshaft 3. More particularly, the thrust bearings 16 may be associated with the first crankshaft support and the third crankshaft support. For example, the thrust bearings 16 may be positioned on one side of the first block support 10*a* and on opposing sides of the third block support 10*c*. In addition, the thrust bearings 16 may be positioned on one side of the first cap support 4*a* and opposing sides of the third cap support 4*c*.

Figure 6:
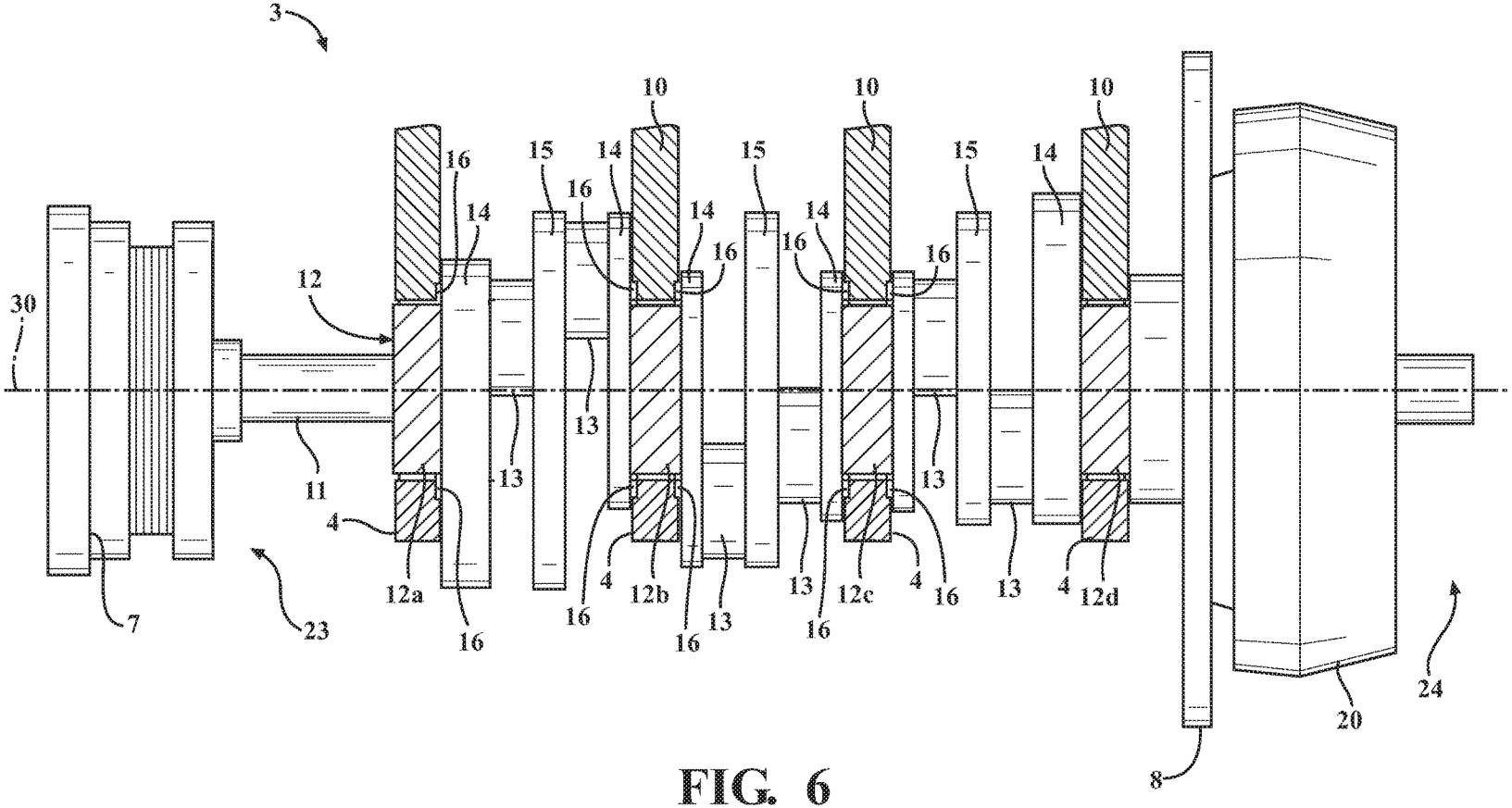
FIG. 6 is a partial cross-sectional view of an example of a crankshaft with supporting structures, showing a fourth arrangement of multiple thrust bearings.

FIG. 6 shows a fourth arrangement of multiple thrust bearings 16 for supporting the crankshaft 3. More particularly, the thrust bearings 16 may be associated with the first crankshaft support, the second crankshaft support, and the third crankshaft support. For example, the thrust bearings 16 may be positioned on one side of the first block support 10*a*, on opposing sides of the second block support 10*b*, and on opposing sides of the third block support 10*c*. In addition, the thrust bearings 16 may be positioned on one side of the first cap support 4*a*, on opposing sides of the second cap support 4*b*, and on opposing sides of the third cap support 4*c*.

Figure 7:
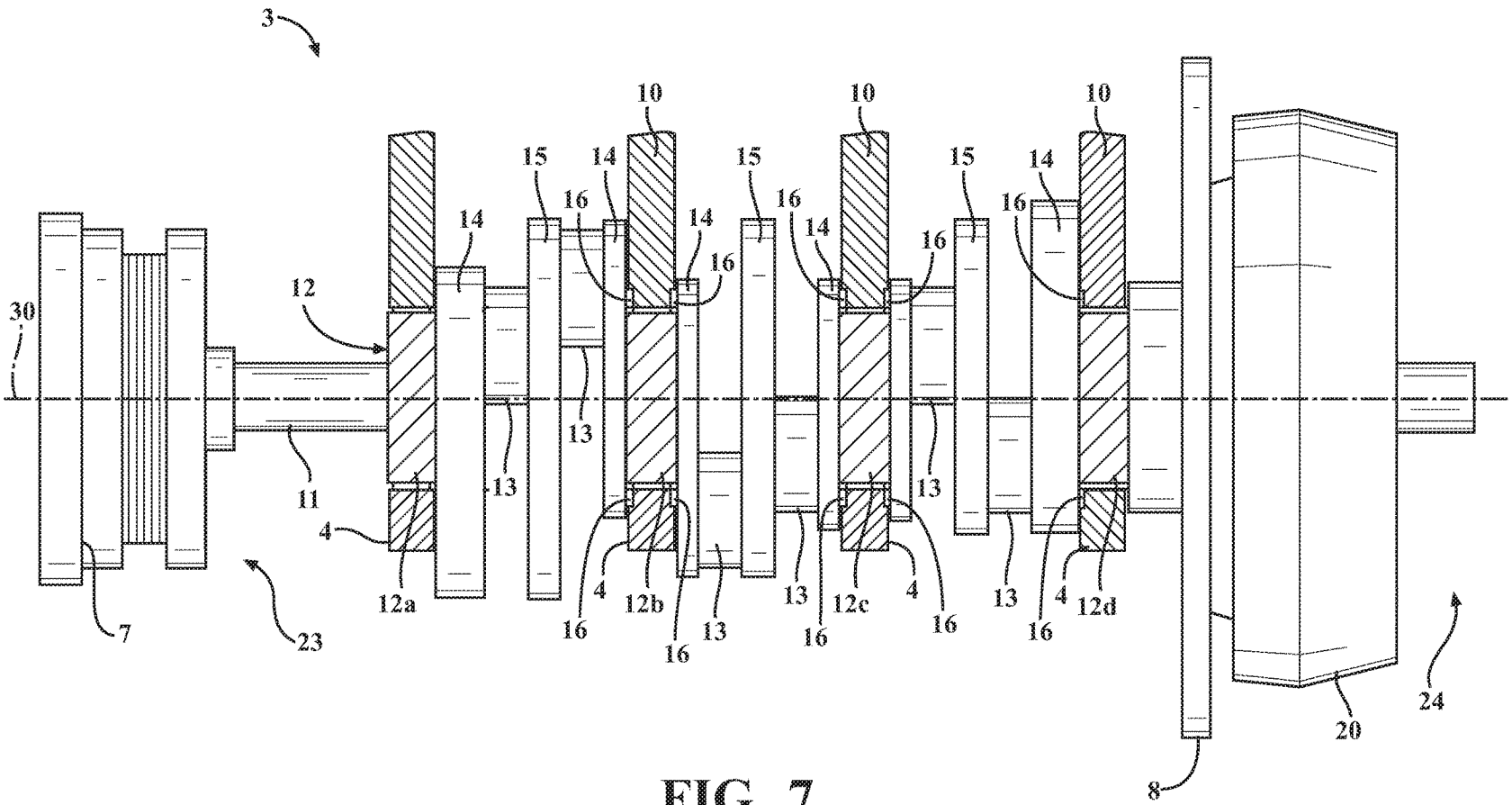
FIG. 7 is a partial cross-sectional view of an example of a crankshaft with supporting structures, showing a fifth arrangement of multiple thrust bearings.

FIG. 7 shows a fifth arrangement of multiple thrust bearings 16 for supporting the crankshaft 3. More particularly, the thrust bearings 16 may be associated with the second, crankshaft support, the third crankshaft support, and the fourth crankshaft support. For example, the thrust bearings 16 may be positioned on opposing sides of the second block support 10*b*, on opposing sides of the third block support 10*c*, and on one side of the fourth block support 10*d*. In addition, the thrust bearings 16 may be positioned on opposing sides of the second cap support 4*b*, on opposing sides of the third cap support 4*c*, and on one side of the fourth cap support 4*d*.

Figure 8:
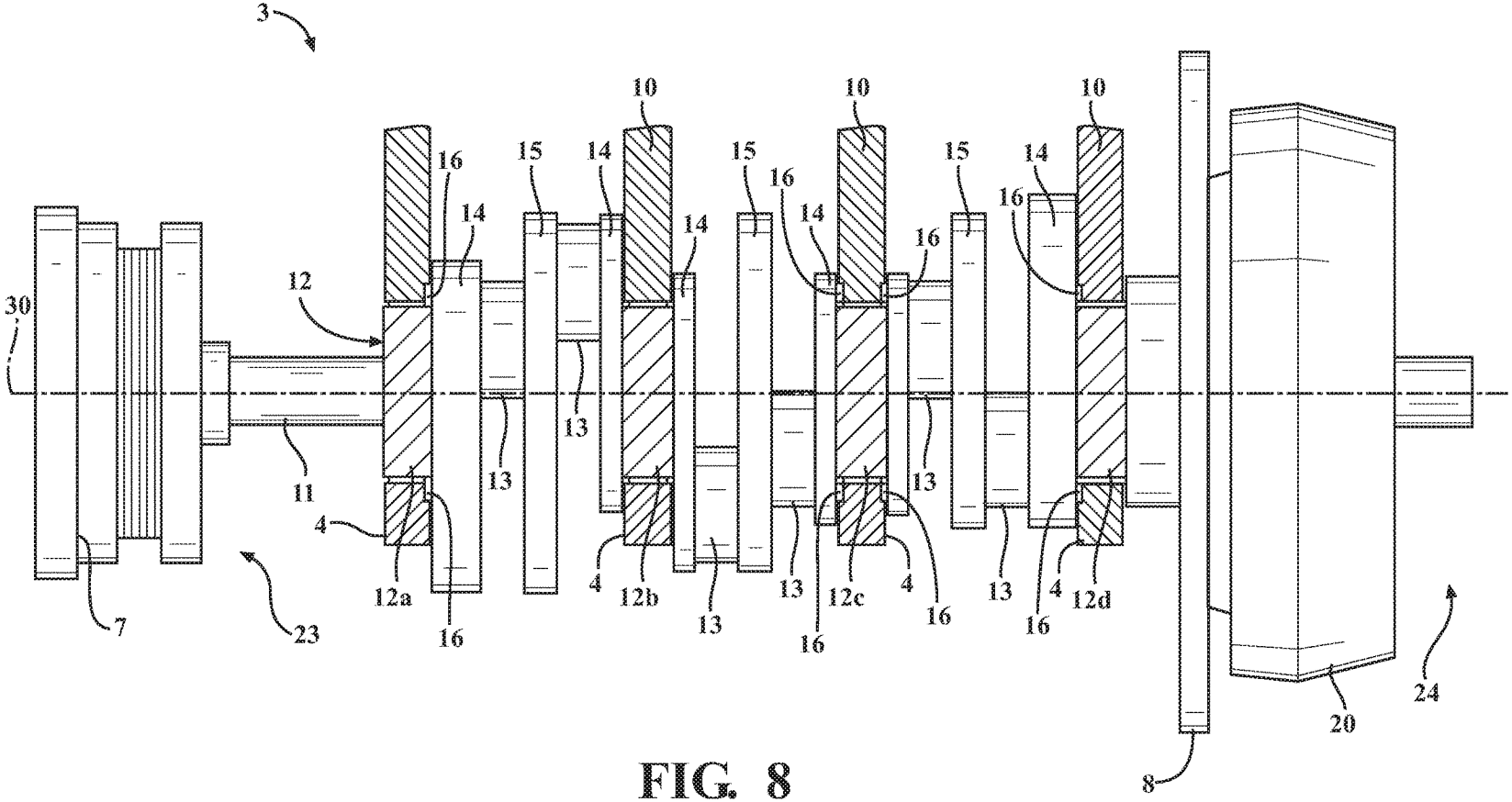
FIG. 8 is a partial cross-sectional view of an example of a crankshaft with supporting structures, showing a sixth arrangement of multiple thrust bearings.

FIG. 8 shows a sixth arrangement of multiple thrust bearings 16 for supporting the crankshaft 3. More particularly, the thrust bearings 16 may be associated with the first, crankshaft support, the third crankshaft support, and the fourth crankshaft support. For example, the thrust bearings 16 may be positioned on one side of the first block support 10*a*, on opposing sides of the third block support 10*c*, and on one side of the fourth block support 10*d*. In addition, the thrust bearings 16 may be positioned on one side of the first cap support 4*a*, on opposing sides of the third cap support 4*c*, and on one side of the fourth cap support 4*d*.

Figure 9:
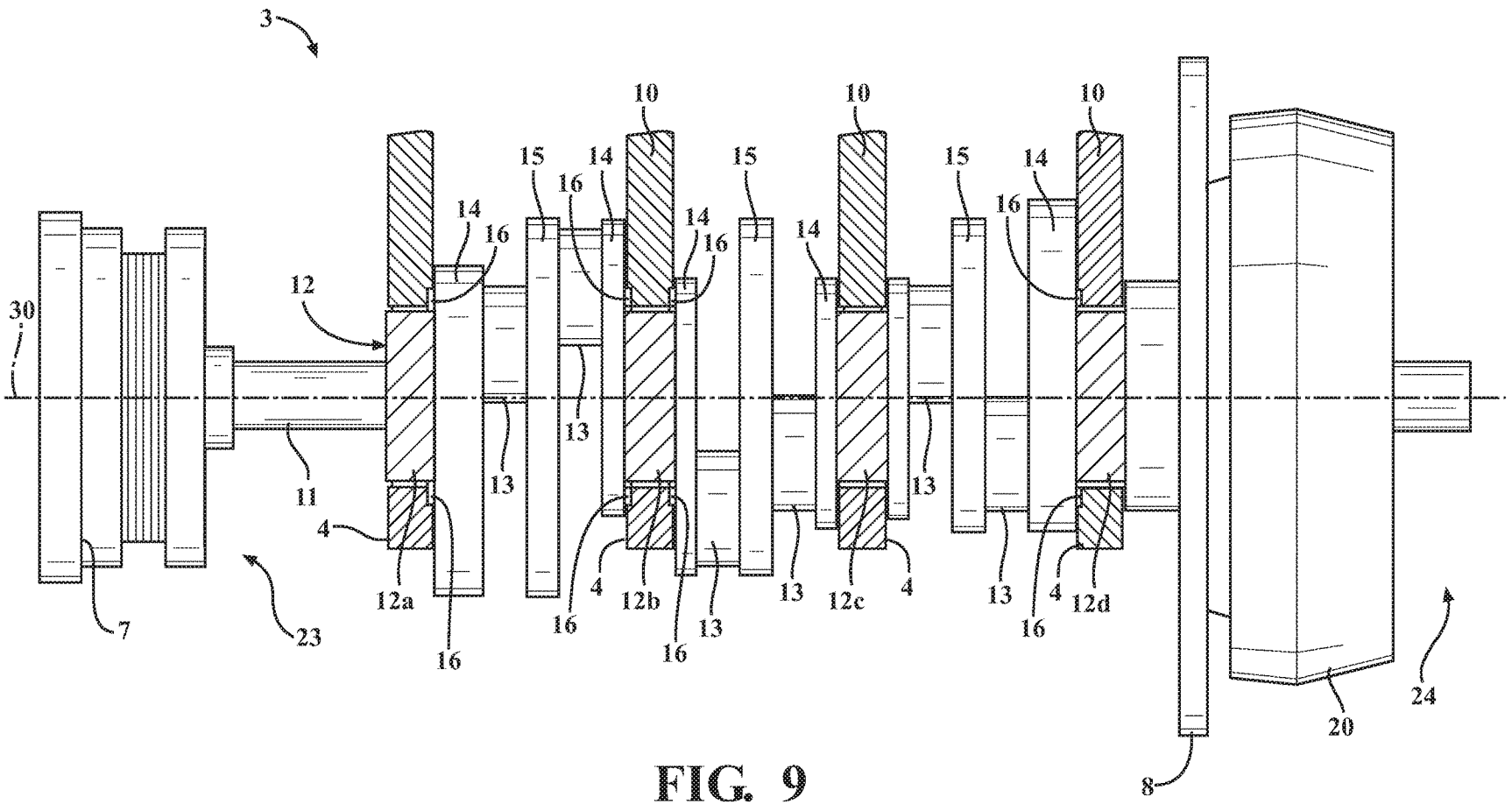
FIG. 9 is a partial cross-sectional view of an example of a crankshaft with supporting structures, showing a seventh arrangement of multiple thrust bearings.

FIG. 9 shows a seventh arrangement of multiple thrust bearings 16 for supporting the crankshaft 3. More particularly, the thrust bearings 16 may be associated with the first crankshaft support, the second, crankshaft support, and the fourth crankshaft support. For example, the thrust bearings 16 may be positioned on one side of the first block support

10*a*, on opposing sides of the second block support 10*b*, and on one side of the fourth block support 10*d*. Alternatively or additionally, the thrust bearings 16 may be positioned on one side of the first cap support 4*a*, on opposing sides of the second cap support 4*b*, and on one side of the fourth cap support 4*d*.

In one or more arrangements, the thrust bearings 16 and the radial bearings 9 may be separate elements, as is shown in the Figures. However, in one or more arrangements, a radial bearing 9 and at least one thrust bearing 16 may be integrated into one unitary structure.

Arrangements herein may be provided in any suitable manner. The various arrangements of the thrust bearings 16 may be provided between the crankshaft 3 and the crankshaft supports such that the thrust bearings 16 may receive forces from the crankshaft 3 during engine operation. The arrangement of the thrust bearings 16 described herein may increase the safety and/or reliability of the crankshaft 3 during engine operation. The arrangement of the thrust bearings 16 described herein may help to maintain the position and/or the stability of the crankshaft 3 at least in the longitudinal direction.

It will be appreciated that arrangements described herein may provide numerous benefits, including one or more of the benefits mentioned herein. Arrangements described herein may improve the reliability and/or safety of engines having greater stroke lengths and/or greater fuel compression. For example, arrangements described can improve the safety factor of a crankshaft used within engines that employ greater piston stroke lengths and/or higher cylinder compressions.

Aspects herein may be embodied in other forms without departing from the spirit or essential attributes thereof. Accordingly, reference should be made to the following claims, rather than to the foregoing specification, as indicating the scope of the invention.

What is claimed is:

1. An internal combustion engine, comprising:

a crankshaft comprising:

multiple crank journals;

at least two crank pins positioned between two of the multiple crank journals neighboring one another; and at least one pin arm, each of the at least one pin arm being positioned between two of the at least two crank pins neighboring one another;

multiple crankshaft supports including two exterior crankshaft supports and a plurality of interior crankshaft supports located between the two exterior crankshaft supports; and multiple thrust bearings distributed about the crankshaft such that only one of the two exterior crankshaft supports does not have an associated thrust bearing and such that only one of the plurality of interior crankshaft supports does not have an associated thrust bearing, each of the crankshaft supports having the associated thrust bearing supporting one of the multiple crank journals, each thrust bearing positioned between the crankshaft and the crankshaft support having the associated thrust bearing.

2. The internal combustion engine of claim 1, wherein there is a single crank pin located between each of the at least one pin arm and a respective one of the multiple thrust bearings nearest to the at least one pin arm.

3. The internal combustion engine of claim 1, further including at least two journal arms, each of the journal arms positioned between one of the crank journals and one of the crank pins adjacent to one of the crank journals.

4. The internal combustion engine of claim 3, wherein there is a single crank pin and a single journal arm between each of the at least one pin arm and a thrust bearing nearest to the at least one pin arm.

5. The internal combustion engine of claim 1, wherein the multiple crankshaft supports includes a first crankshaft support configured to support a first journal, a second crankshaft support configured to support a second journal, a third crankshaft support configured to support a third journal, and a fourth crankshaft support configured to support a fourth journal, wherein the first crankshaft support and the fourth crankshaft support are the two exterior crankshaft supports, wherein the second crankshaft support and the third crankshaft support are the plurality of interior crankshaft supports, wherein the first journal, the second journal, the third journal and the fourth journal are distributed sequentially along a longitudinal axis of the crankshaft, wherein the multiple thrust bearings are located only on opposing sides of the second crankshaft support and opposing sides of the fourth crankshaft support.

6. The internal combustion engine of claim 1, wherein the multiple crankshaft supports includes a first crankshaft support configured to support a first journal, a second crankshaft support configured to support a second journal, a third crankshaft support configured to support a third journal, and a fourth crankshaft support configured to support a fourth journal, wherein the first crankshaft support and the fourth crankshaft support are the two exterior crankshaft supports, wherein the second crankshaft support and the third crankshaft support are the plurality of interior crankshaft supports, wherein the first journal, the second journal, the third journal and the fourth journal are distributed sequentially along a longitudinal axis of the crankshaft, wherein the multiple thrust bearings are located only on opposing sides of the first crankshaft support and opposing sides of the third crankshaft support.

7. An internal combustion engine, comprising:

a crankshaft having six crank pins, four crank journals, and three pin arms;

multiple crankshaft supports configured to support the crankshaft at the four crank journals, the multiple crankshaft supports including two exterior crankshaft supports and a plurality of interior crankshaft supports located between the two exterior crankshaft supports;

a first set of thrust bearings located on opposing sides of a first crankshaft support; and a second set of thrust bearings located on opposing sides of a second crankshaft support, only one of the two exterior crankshaft supports not having an associated thrust bearing, and only one of the plurality of interior crankshaft supports not having an associated thrust bearing.

8. The internal combustion engine of claim 7, wherein the multiple crankshaft supports includes a first crankshaft support configured to support a first journal, a second crankshaft support configured to support a second journal, a third crankshaft support configured to support a third journal, and a fourth crankshaft support configured to support a fourth journal, wherein the first crankshaft support and the fourth crankshaft support are the two exterior crankshaft supports, wherein the second crankshaft support and the third crankshaft support are the plurality of interior crankshaft supports, wherein the first journal, the second journal, the third journal and the fourth journal are distributed sequentially along a longitudinal axis of the crankshaft, wherein the first set of thrust bearings and the second set of thrust bearings are located only on opposing sides of the second crankshaft support and opposing sides of the fourth crankshaft support.

9. The internal combustion engine of claim 7, wherein the multiple crankshaft supports includes a first crankshaft support configured to support a first journal, a second crankshaft support configured to support a second journal, a third crankshaft support configured to support a third journal, and a fourth crankshaft support configured to support a fourth journal, wherein the first crankshaft support and the fourth crankshaft support are the two exterior crankshaft supports, wherein the second crankshaft support and the third crankshaft support are the plurality of interior crankshaft supports, wherein the first journal, the second journal, the third journal and the fourth journal are distributed sequentially along a longitudinal axis of the crankshaft, wherein the first set of thrust bearings and the second set of thrust bearings are located only on opposing sides of the first crankshaft support and opposing sides of the third crankshaft support.

10. The internal combustion engine of claim 7, wherein a distance is defined between each pin arm and a nearest thrust bearing in a longitudinal direction such that multiple distances are defined, and wherein the multiple distances are substantially equal.

11. An internal combustion engine, comprising:

a crankshaft comprising:

multiple crank journals;

at least two crank pins positioned between two of the multiple crank journals neighboring one another; and at least one pin arm, each of the at least one pin arm being positioned between two of the at least two crank pins neighboring one another;

multiple crankshaft supports including two exterior crankshaft supports and a plurality of interior crankshaft supports located between the two exterior crankshaft supports; and multiple thrust bearings distributed about the crankshaft such that the two exterior crankshaft supports have an associated thrust bearing and such that only one of the plurality of interior crankshaft supports does not have an associated thrust bearing, each of the crankshaft supports having the associated thrust bearing supporting one of the multiple crank journals, each thrust bearing positioned between the crankshaft and the crankshaft support having the associated thrust bearing.

12. The internal combustion engine of claim 11, wherein the multiple crankshaft supports includes a first crankshaft support configured to support a first journal, a second crankshaft support configured to support a second journal, a third crankshaft support configured to support a third journal, and a fourth crankshaft support configured to support a fourth journal, wherein the first crankshaft support and the fourth crankshaft support are the two exterior crankshaft supports, wherein the second crankshaft support and the third crankshaft support are the plurality of interior crankshaft supports, wherein the first journal, the second journal, the third journal and the fourth journal are distributed sequentially along a longitudinal axis of the crankshaft, wherein the multiple thrust bearings are located only on opposing sides of the first crankshaft support, opposing sides of the third crankshaft support, and opposing sides of the fourth crankshaft support.

13. The internal combustion engine of claim 11, wherein the multiple crankshaft supports includes a first crankshaft support configured to support a first journal, a second crankshaft support configured to support a second journal, a third crankshaft support configured to support a third journal, and a fourth crankshaft support configured to support a fourth journal, wherein the first crankshaft support and the fourth crankshaft support are the two exterior crankshaft supports, wherein the second crankshaft support and the third crankshaft support are the plurality of interior crankshaft supports, wherein the first journal, the second journal, the third journal and the fourth journal are distributed sequentially along a longitudinal axis of the crankshaft, wherein the multiple thrust bearings are located only on opposing sides of the first crankshaft support, opposing sides of the second crankshaft support, and opposing sides of the fourth crankshaft support.

14. An internal combustion engine, comprising:

a crankshaft comprising:

multiple crank journals;

at least two crank pins positioned between two of the multiple crank journals neighboring one another; and at least one pin arm, each of the at least one pin arm being positioned between two of the at least two crank pins neighboring one another;

multiple crankshaft supports including two exterior crankshaft supports and a plurality of interior crankshaft supports located between the two exterior crankshaft supports; and multiple thrust bearings distributed about the crankshaft such that the two exterior crankshaft supports do not have an associated thrust bearing and such that each of the plurality of interior crankshaft supports has at least one associated thrust bearing, each of the crankshaft supports having the associated thrust bearing supporting one of the multiple crank journals, each thrust bearing positioned between the crankshaft and the crankshaft support having the associated thrust bearing.

15. The internal combustion engine of claim 14, wherein the multiple crankshaft supports includes a first crankshaft support configured to support a first journal, a second crankshaft support configured to support a second journal, a third crankshaft support configured to support a third journal, and a fourth crankshaft support configured to support a fourth journal, wherein the first crankshaft support and the fourth crankshaft support are the two exterior crankshaft supports, wherein the second crankshaft support and the third crankshaft support are the plurality of interior crankshaft supports, wherein the first journal, the second journal, the third journal and the fourth journal are distributed sequentially along a longitudinal axis of the crankshaft, wherein the multiple thrust bearings are located only on opposing sides of the second crankshaft support and opposing sides of the third crankshaft support.

16. An internal combustion engine, comprising:

a crankshaft comprising:

multiple crank journals;

at least two crank pins positioned between two of the multiple crank journals neighboring one another; and at least one pin arm, each of the at least one pin arm being positioned between two of the at least two crank pins neighboring one another;

multiple crankshaft supports including two exterior crankshaft supports and a plurality of interior crankshaft supports located between the two exterior crankshaft supports; and multiple thrust bearings distributed about the crankshaft such that only one of the two exterior crankshaft supports does not have an associated thrust bearing and such that each of the plurality of interior crankshaft supports has an associated thrust bearing, each of the crankshaft supports having the associated thrust bearing supporting one of the multiple crank journals, each thrust bearing positioned between the crankshaft and the crankshaft support having the associated thrust bearing.

17. The internal combustion engine of claim 16, wherein the multiple crankshaft supports includes a first crankshaft support configured to support a first journal, a second crankshaft support configured to support a second journal, a third crankshaft support configured to support a third journal, and a fourth crankshaft support configured to support a fourth journal, wherein the first crankshaft support and the fourth crankshaft support are the two exterior crankshaft supports, wherein the second crankshaft support and the third crankshaft support are the plurality of interior crankshaft supports, wherein the first journal, the second journal, the third journal and the fourth journal are distributed sequentially along a longitudinal axis of the crankshaft, wherein the multiple thrust bearings are located only on opposing sides of the first crankshaft support, opposing sides of the second crankshaft support, and opposing sides of the third crankshaft support.

18. The internal combustion engine of claim 16, wherein the multiple crankshaft supports includes a first crankshaft support configured to support a first journal, a second crankshaft support configured to support a second journal, a third crankshaft support configured to support a third journal, and a fourth crankshaft support configured to support a fourth journal, wherein the first crankshaft support and the fourth crankshaft support are the two exterior crankshaft supports, wherein the second crankshaft support and the third crankshaft support are the plurality of interior crankshaft supports, wherein the first journal, the second journal, the third journal and the fourth journal are distributed sequentially along a longitudinal axis of the crankshaft, wherein the multiple thrust bearings are located only on opposing sides of the second crankshaft support, opposing sides of the third crankshaft support, and opposing sides of the fourth crankshaft support.

19. An internal combustion engine, comprising:

a crankshaft having six crank pins, four crank journals, and three pin arms;

multiple crankshaft supports configured to support the crankshaft at the four crank journals, the multiple crankshaft supports including two exterior crankshaft supports and a plurality of interior crankshaft supports located between the two exterior crankshaft supports;

a first set of thrust bearings located on opposing sides of a first crankshaft support; and a second set of thrust bearings located on opposing sides of a second crankshaft support, the two exterior crankshaft supports not having an associated thrust bearing, and each of the plurality of interior crankshaft supports having an associated thrust bearing.

20. The internal combustion engine of claim 19, wherein the multiple crankshaft supports includes a first crankshaft support configured to support a first journal, a second crankshaft support configured to support a second journal, a third crankshaft support configured to support a third journal, and a fourth crankshaft support configured to support a fourth journal, wherein the first crankshaft support and the fourth crankshaft support are the two exterior crankshaft supports, wherein the second crankshaft support and the third crankshaft support are the plurality of interior crankshaft supports, wherein the first journal, the second journal, the third journal and the fourth journal are distributed sequentially along a longitudinal axis of the crankshaft, wherein the first set of thrust bearings and the second set of thrust bearings are located only on opposing sides of the second crankshaft support and opposing sides of the third crankshaft support.

21. An internal combustion engine, comprising:

a crankshaft having six crank pins, four crank journals, and three pin arms;

multiple crankshaft supports configured to support the crankshaft at the four crank journals, the multiple crankshaft supports including two exterior crankshaft supports and a plurality of interior crankshaft supports located between the two exterior crankshaft supports;

a first set of thrust bearings located on opposing sides of a first crankshaft support; and a second set of thrust bearings located on opposing sides of a second crankshaft support, only one of the two exterior crankshaft supports not having an associated thrust bearing, and each of the plurality of interior crankshaft supports having an associated thrust bearing.

22. The internal combustion engine of claim 19, wherein the multiple crankshaft supports includes a first crankshaft support configured to support a first journal, a second crankshaft support configured to support a second journal, a third crankshaft support configured to support a third journal, and a fourth crankshaft support configured to support a fourth journal, wherein the first crankshaft support and the fourth crankshaft support are the two exterior crankshaft supports, wherein the second crankshaft support and the third crankshaft support are the plurality of interior crankshaft supports, wherein the first journal, the second journal, the third journal and the fourth journal are distributed sequentially along a longitudinal axis of the crankshaft, wherein the first set of thrust bearings and the second set of thrust bearings are located only on opposing sides of the first crankshaft support, opposing sides of the second crankshaft support, and opposing sides of the third crankshaft support.

23. The internal combustion engine of claim 21, wherein the multiple crankshaft supports includes a first crankshaft support configured to support a first journal, a second crankshaft support configured to support a second journal, a third crankshaft support configured to support a third journal, and a fourth crankshaft support configured to support a fourth journal, wherein the first crankshaft support and the fourth crankshaft support are the two exterior crankshaft supports, wherein the second crankshaft support and the third crankshaft support are the plurality of interior crankshaft supports, wherein the first journal, the second journal, the third journal and the fourth journal are distributed sequentially along a longitudinal axis of the crankshaft, wherein the first set of thrust bearings and the second set of thrust bearings are located only on opposing sides of the second crankshaft support, opposing sides of the third crankshaft support, and opposing sides of the fourth crankshaft support.

* * * * *